US005748074A

United States Patent [19]

Chomet

[11] Patent Number: 5,748,074

[45] Date of Patent: May 5, 1998

[54] ELECTRONIC DOOR CHIME

[75] Inventor: Marc Chomet, Huntington, N.Y.

[73] Assignee: Fred M. Schildwachter & Sons, Inc., Bronx, N.Y.

[21] Appl. No.: 747,912

[22] Filed: Nov. 12, 1996

[51] Int. Cl.[6] ..... G08B 3/00

[52] U.S. Cl. ..... 340/328; 340/539; 340/693; 340/825.19; 340/333; 340/384.1; 340/392.4; 361/160; 361/182

[58] Field of Search ..... 340/328, 539, 340/693, 333, 541, 545, 384.1, 392.4, 392.1, 393.2, 401.1, 392.5, 825.69, 825.72; 361/160, 182; 307/110

[56] References Cited

U.S. PATENT DOCUMENTS 4,236,147 11/1980 Calvin ..... 340/553

4,523,193 6/1985 Levinson et al. ..... 340/825.69

5,568,122 10/1996 Xydis ..... 340/539

*Primary Examiner*—Jeffery Hofsass

*Assistant Examiner*—Daryl C. Pope

*Attorney, Agent, or Firm*—Eliot S. Gerber

[57] ABSTRACT

A circuit for actuating a door chime has a dc power source in series with a resistor and in shunt with a capacitor. A remote push button transmits a radio signal to the circuit, to connect a solenoid in series with the power source and the resistor and in shunt with the capacitor, which causes a relatively large pulse of current from the instantaneous combination of the power source current and the current from the charge of the capacitor to be applied to the solenoid which is arranged to strike a tone bar. The resistor in series with the capacitor has a time constant that charges the capacitor adequately between cycles of the operation of the push button and the resistance of the resistor limits the current flow from the power source.

19 Claims, 1 Drawing Sheet

ELECTRONIC DOOR CHIME

BACKGROUND OF THE INVENTION

1. Field of the Invention

This invention relates to an electro-mechanical door chime which is activated by a remote door-mounted switch and radio transmitter.

2. Prior Art

Early forms of door bell sounding systems typically comprise a 110-volt ac (alternating current) power supply with a step-down transformer which produces 12 volts. A door bell switch, generally a push-button switch, is connected, by wires, to an electro-mechanical door chime in which a solenoid is used to drive a plunger which strikes a bell or bar chime. See U.S. Pat. No. 5,420,564.incorporated by reference.

Some prior art circuits provide wireless transmission from a remote radio transmitter unit, mounted near a door and having a push-button switch, to a remote receiver circuit having an electronic tone generator and loudspeaker. See U.S. Pat. No. 4,523,193, incorporated by reference. Such remote receivers have been battery operated or powered from household ac using small low power transformers, because of space and cost limitations. However, such electronic tone generators (or melody synthesizers) and their loudspeakers do not provide the loud and clear tones that are obtainable from striking a tone bar. Their electronically generated sounds are relatively soft and unclear compared to a electromechanical tone bar chime.

It is generally believed that a low ac power operated, or battery operated, tone bar chime is not feasible. Such devices have not been produced, as such low power sources have not been considered sufficient to operate a solenoid's plunger with sufficient force to produce a clear and loud tone.

OBJECT OF THE INVENTION

It is an object of this invention to overcome the problems attending electronic door sounding circuits utilizing loudspeakers by providing a circuit that uses a small size transformer, in the case of ac power, or uses small size batteries, and moreover provides sufficiently large output current pulses to forcefully activate the plunger of a solenoid to strike a tone bar.

SUMMARY OF THE INVENTION

According to the present invention, a transmitter unit comprising a push-button switch and a radio transmitter is located near a door. A receiver unit, inside the house or office, comprises a radio receiver, a power source such as a battery or low power transformer, a metal tone bar, a solenoid and a circuit to activate the solenoid.

The activation circuit includes a resistor and capacitor, the resistor automatically charging the capacitor at a prescribed rate. In response to the remote push button switch, the radio receiver generates a command signal which opens a normally closed electronic switch so that the capacitor is discharged. A large output current pulse is generated comprising the sum of the charge stored in the capacitor and the current from the battery. That current pulse activates the solenoid and its plunger hits the tone bar.

DETAILED DESCRIPTION OF THE PRESENTLY PREFERRED EMBODIMENT

Figure 1:
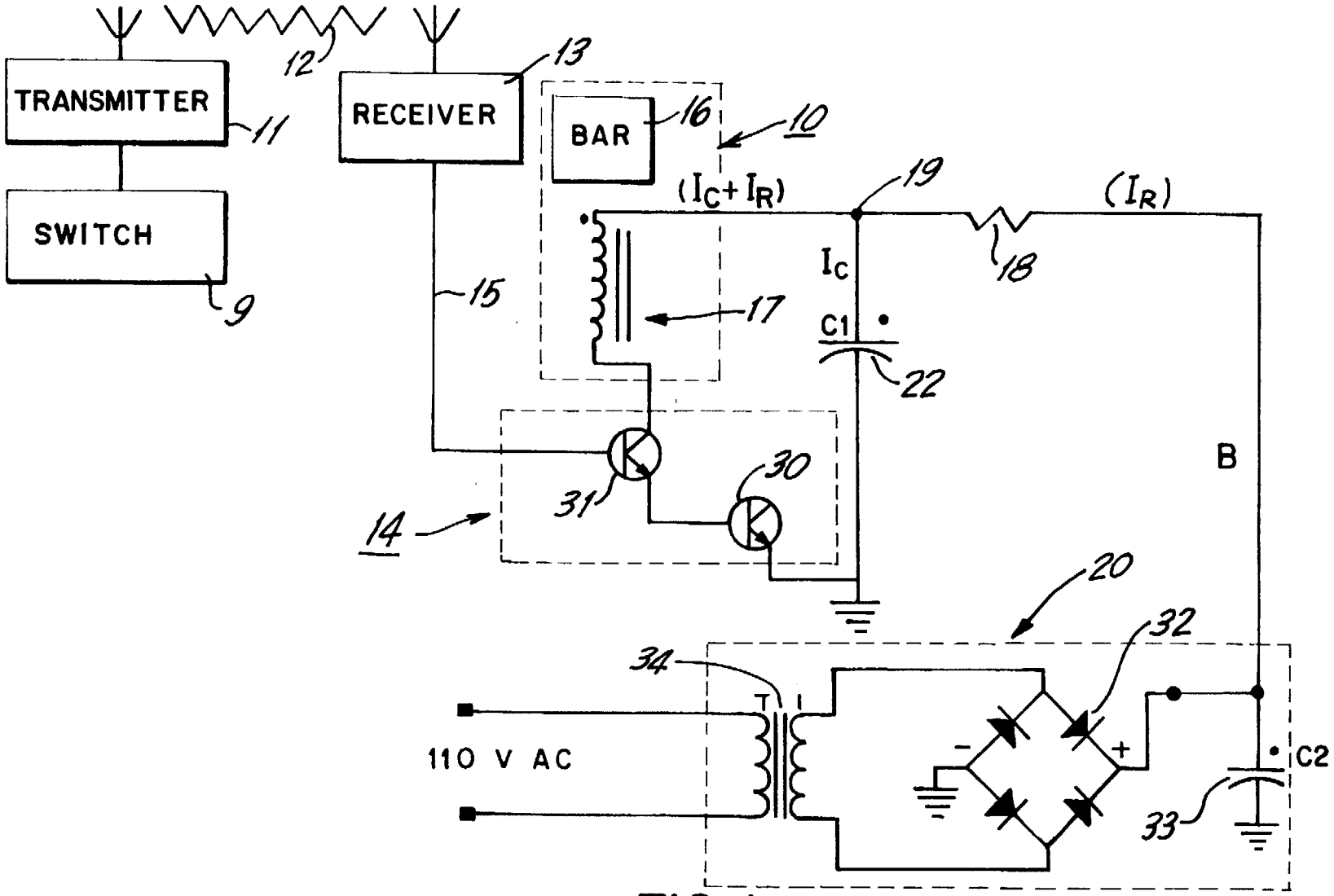
FIG. 1 is a block schematic view of one embodiment of the invention.

As shown in FIG. 1, a manual push-button on-off (open-closed) switch 9 is mounted proximate a door. The normally off switch 9 controls a radio transmitter 11 which locally broadcasts a radio signal 12 to the radio receiver 13 in response to closure of switch 9. The transmitter 11 may be battery powered, for example, by a 12-volt dc (direct current) battery, or may be powered by household ac power after being rectified to dc power. The radio signal 12 is converted to an electrical command signal by radio receiver 13 which transmits the command signal from receiver 13 over wire 15 to electronic switch 14. The receiver 13 and its coupled circuitry, and the sounder mechanism 10, are preferably within a casing which is positioned within the house or office. See U.S. Pat. No. 4,523,193, incorporated by reference herein, for details concerning a radio transmitter-receiver doorbell system.

A sounder assembly 10, of known form, is arranged to provide one or more audible sounds when energized. The preferred sounder assembly includes a door chime, preferably a flat metal bar 16, which is struck by the plunger of solenoid 17 to generate a tone. The solenoid requires at least 1 ampere for operation and preferably operates in the range 1–5 amperes and most preferably about 2 amperes. A sound tone is generated in response to an energizing output current pulse applied to the solenoid 17 which extends the solenoid plunger to strike a chime, such as a metal flat bar 16 or a bell. The plunger is normally withdrawn (not extended) by a spring.

A capacitor 22 (C1) having a capacitance C, and polarity as shown by the dot, is connected in shunt both across the solenoid 17 and resistor 18 having a resistance R. A dc power source 20 is in series combination at the junction 19 of the respective terminals of resistor 18 and solenoid 17.

The power source 20 providing a potential B has a capacity of less than 700 milliamperes and is preferably about 500 milliamperes (at 16 volts). The preferred power source 20 is an ac/dc converter comprising a four-diode full-wave bridge 32, preferably Type IN4001; a capacitor 33 (C2) of 100 MF and a small low power step-down transformer 34 (T). The transformer is preferably type 135-0134 (110 volts to 16 volts) and is rated at 300 milliamperes at its secondary coil (at 16 volts). The term low power dc source means a source of less than 700 milliamperes, for example, a step-down transformer T rated at 200 to 500, and most preferably at 300, milliamperes at its secondary coil at 16 volts.

In operation, with electronic switch 14 in its normally open (off) position, the capacitor C1 will be charged automatically by the current passing through resistor 18 from power source 20.

A full charge on the capacitor 22 will develop at the potential B of the power source in the absence of a closure of electronic switch 14. However, about 63% of the potential B is achieved at the time constant rate of the RC network of resistor 18 and capacitor 22. The time factor, in seconds, is the product of the resistance R in megohms and the capacitance C in microfarads. The significance of the time factor according to the present invention will be described below.

Upon closure of electronic switch 14, the previously automatically stored charge on the capacitor 22 (C1) will produce a large current pulse $I_C$, in the range of 1–3 amperes, which is applied across the terminals of solenoid 17. Simultaneously, an additional dc current $I_R$ is passed from power source 20 through resistor 18 to the solenoid 17, providing thereby a combined current pulse $I_C+I_R$. The current flows automatically through resistor 18 from the power source 20 as the voltage of the capacitor falls in the discharge process. The effective current pulse is the instantaneous combination of the currents $I_R$ and $I_C$.

The combined current waveform (current pulse) of the two currents is in the range of 1.1 to 3.5 amperes. The current pulse from the capacitor 22 is combined with the resistor current resulting in that combined waveform. The current pulse from the capacitor is relatively large, on the order of 1 to 3 amperes, while the current from the power source 20 through resistor 18 is quite small, in the milliampere range. The instantaneous sum and waveform of the two currents is adequate to energize the solenoid 17.

More specifically, the approximate magnitude of the current $I_R$ is an ohm's law calculation of the voltage B and the resistance R. However, the determination of the pulse of current discharged by the capacitor is more complex and is determined by the capacitance C1, the potential across the capacitor, which is essentially the potential of the power source 20, and the inductive effect of the solenoid 17.

The capacitor pulse current is made relatively large by selecting the proper sized capacitor in the range of 3000 to 20,000 mfd, and most preferably 6800 mfd. The value of $I_R$ from the resistor is only 160 milliamperes, which is 16 volts divided by 100 ohms. This is within the 300 milliamperes capacity of the transformer. The voltage from the capacitor and the charging current through R will develop over 1 ampere of combined current pulse $I_C+I_R$.

As shown in FIG. 1, the electronic switch 14 is a transistor circuit (charging circuit) comprising two transistors 30 and 31 arranged in a Darlington circuit. Preferably the transistors 30 and 31 may be respectively type TIP 31 (30) and 2N 3643 (31).

A specific embodiment of the invention, as embodied in FIG. 1, comprises R-18 at 100 ohms and C-22 at 6800 mfd. The power source 20 is preferably a transformer and full-wave bridge circuit, as shown in FIG. 1. Alternatively the power source 20 is a battery, preferably three "AA" cells arranged in series. Solenoid 12 is comprised of a copper wound coil whose DC resistance is in the range of 8 to 16 ohms. The sounder assembly preferably includes a tone bar which is a flat metal bar. Depending on the pitch desired, the tone bar is preferably between 5 and 6 inches long, 1 inch wide, and 0.1 inch thick. This is only an example, as the size depends on the tone which is desired.

According to one embodiment of the invention with the components enumerated above, the RC time constant for charging the capacitor is about 680 milliseconds (0.1 millimegohms×6800 mfd=680 milliseconds). The charging current typically would have a peak of about 100 milliamperes. The operating cycle of the manual push button switch 9 is typically one second, i.e., 1000 milliseconds, which is greater than the RC time constant of 680 milliseconds, allowing the capacitor to recharge and discharge within the operating cycle of the manual push button switch, i.e., the capacitor has time to recharge before the manual switch is again closed. Accordingly, rapid repeated operations of the push button switch 9 will not disturb the operation of the circuit. Moreover, since the capacitor C (6800 mfd) provides a current pulse lasting from 0.05 to 0.1 seconds, the required energization of the solenoid 17 is achieved. The charging and discharging current from power source 20 is small, less than 700 milliamperes and preferably in the range of 200 to 400 milliamperes so that, in the case of a battery, a small size battery may be used. Such small size of the battery permits the use of a small casing.

It is thus to be appreciated and understood that, according to the present invention, a relatively low current source, i.e., a small low power transformer and bridge circuit or a dry cell battery, will provide a source of large output current pulse from a charged capacitor. For example, the ratio of the current from the power source to the current pulse to operate the battery is preferably at least 1:2 and more preferably in the range 1:2 to 1:6 and most preferably about 1:4. That current is sufficient to meet the operating requirements of a solenoid. In the case of a battery, a smaller size, for example, AA size, can be used in place of larger size cells, such as D size cells.

What is claimed is:

1. A door chime system comprising a radio transmitter and a radio receiver, the door chime transmitter comprising:

(a) a manually operable switch having open and closed positions;

(b) a radio transmitter means to generate and transmit a radio signal when the manually operable switch is operated to be in the closed position;

the door chime radio receiver comprising:

(c) a radio receiver means to receive the radio signal from the transmitter and to generate a control signal in response thereto;

(d) a dc power source, said power source having a limited current pulse capacity of less than 700 milliamperes;

(e) chime means to generate a tone sound when struck;

(f) a solenoid responsive to an output electrical current pulse for striking the chime means, said solenoid capable of being energized only with a current pulse value greater than the current pulse capacity of said power source;

(g) an electronic switch having a normally open and closed positions and being connected to, and controlled by, the control signal from the radio receiver;

(h) a capacitor in series with the electronic switch, the electronic switch when closed discharging said output electrical pulse stored in said capacitor to said solenoid;

(i) a resistor means coupled to said battery to provide a charging current to said capacitor when said electronic switch is open, said resistor means having a value of resistance that limits the charging current to said capacitor to the pulse current capacity of said power source;

(j) wherein said electronic switch, when closed, discharges said current charge on said capacitor to thereby operate said solenoid.

2. A door chime system as in claim 1 wherein said electronic switch, simultaneously with discharging the capacitor, conducts power from said power source to said solenoid.

3. A door chime system according to claim 1 wherein said power source comprises a transformer and an ac/dc converter.

4. A door chime system according to claim 3 wherein the converter is a full-wave bridge circuit.

5. A door chime system according to claim 1 wherein said electronic switch includes two transistors in a Darlington circuit, the transistors responding to said control signal to couple said solenoid in circuit with said resistor and said capacitor.

6. A door chime system according to claim 1 wherein said resistor means and capacitor form an RC network having a time constant that is less than the operating time of said manual switch.

7. A door chime system according to claim 1 wherein the chime means includes a metal bar which sounds a tone when struck.

8. A door chime system according to claim 7 wherein the solenoid has a plunger which is extended to strike the bar upon operation of the solenoid.

9. A door chime system according to claim 1 wherein the mechanical switch is a push-button switch.

10. A door chime system according to claim 1 wherein the power source is a battery.

11. A door sounder system comprising:

(a) a transmitter casing having therein a manual switch having open and closed positions and a radio transmitter means to generate a radio signal on the manual switch's closed position;

(b) a receiver casing having therein:

(i) radio receiver means to receive the radio signal and to generate a control signal in response thereto;

(ii) a dc power source having a pulse capacity of less than 700 milliamperes and having two terminals;

(iii) a resistor having two terminals;

(iv) a capacitor having two terminals;

(v) an electronic switch;

(vi) a solenoid which requires more than one ampere for operation and having terminals and a plunger for actuating a door bell sounder;

(vii) a door bell sounder operatively coupled to said solenoid and arranged to generate an audible sound when struck by said solenoid plunger;

wherein one terminal of said resistor is connected to one terminal of said power source, and the other terminal og said resistor is connected to one terminal of said capacitor and one terminal of said solenoid, one terminal of said solenoid is connected to said electronic switch, and other terminals of said switch, capacitor and said power source being respectively commonly connected;

wherein an output pulse is discharged from said capacitor comprising said current pulse from said capacitor and a current flow through said resistor when the electronic switch is closed, said output pulse being of sufficient magnitude to energize said solenoid, and having a pulse value significantly greater than the current flowing through said resistor.

12. A door chime system according to claim 11 wherein said electronic switch includes two transistors in a Darlington circuit, which electronic switch responds to said control signal to couple said solenoid in circuit with said resistor and said capacitor.

13. A door chime according to claim 11 wherein said resistor and capacitor form an RC network having a time constant that is less than the operating time of said manual switch.

14. A door chime system according to claim 11 wherein the sounder includes a metal bar which sounds a tone when struck.

15. A door chime system according to claim 14 wherein the solenoid has a plunger which is extended to strike the bar upon energizing the solenoid.

16. A door chime system according to claim 11 wherein the manual switch is a push-button switch.

17. A door chime system comprising a radio transmitter and a radio receiver, the door chime transmitter comprising:

(a) a manually operable switch having open and closed positions;

(b) a radio transmitter means to generate and transmit a radio signal when the manually operable switch is operated to be in the closed position;

the door chime radio receiving comprising a casing, and within the casing:

(c) a radio receiver means to receive the radio signal from the transmitter and to generate a control signal in response thereto;

(d) a dc power source, said power source having a limited current pulse capacity of less than 700 milliamperes;

(e) a metal tone bar which generates a tone sound when struck;

(f) a solenoid responsive to an output electrical current pulse and having a plunger for striking the tone bar, said solenoid capable of being energized only with a current pulse value greater than the current pulse capacity of said power source;

(g) an electronic switch having a normally open and closed position and being connected to, and controlled by the control signal from the radio receiver;

(h) a capacitor in series with the electronic switch, the electronic switch when closed discharging said output electrical pulse stored in said capacitor to said solenoid;

(i) a resistor means coupled to said battery to provide a charging current to said capacitor when said electronic switch is open, said resistor means having a value of resistance that limits the charging current to said capacitor to the pulse current capacity of said power source;

(j) wherein said electronic switch, when closed, discharges said current charge on said capacitor and simultaneously conducts current from said power source to said solenoid to thereby energize said solenoid.

18. A door chime system according to claim 17 wherein said electronic switch includes two transistors in a Darlington circuit, the transistors responding to said control signal to couple said solenoid in circuit with said resistor and said capacitor.

19. A door chime system according to claim 17 wherein said resistor means and capacitor form an RC network having a time constant that is less than the operating time of said manual switch.

* * * * *